US007781689B2

(12) United States Patent
Jur et al.

(10) Patent No.: US 7,781,689 B2
(45) Date of Patent: Aug. 24, 2010

(54) NETWORK PROTECTOR RETROFIT HANDLE ASSEMBLY

(75) Inventors: Arthur J. Jur, Greenwood, SC (US); John M. Kokenda, Greenwood, SC (US); Mark A. Faulkner, Greenwood, SC (US); Stephen W. Oneufer, Greenwood, SC (US); John R. Moffat, Greenwood, SC (US); Richard L. Hotchkiss, Greenwood, SC (US)

(73) Assignee: Eaton Corporation, Cleveland, OH (US)

( * ) Notice: Subject to any disclaimer, the term of this patent is extended or adjusted under 35 U.S.C. 154(b) by 544 days.

(21) Appl. No.: 11/842,494

(22) Filed: Aug. 21, 2007

(65) Prior Publication Data

US 2009/0050457 A1 Feb. 26, 2009

(51) Int. Cl.
*H01H 3/04* (2006.01)

(52) U.S. Cl. ..... 200/335; 200/50.21; 200/331

(58) Field of Classification Search ..... 200/50.21, 200/331, 335
See application file for complete search history.

(56) References Cited

U.S. PATENT DOCUMENTS 6,642,463 B1 * 11/2003 Turner ..... 200/331
6,838,626 B2 * 1/2005 Deylitz et al. ..... 200/50.21
6,998,550 B1 * 2/2006 Jur et al. ..... 200/50.21

* cited by examiner

*Primary Examiner*—Edwin A. Leon
(74) *Attorney, Agent, or Firm*—Martin J. Moran

(57) ABSTRACT

A retrofit operating handle assembly structured to allow a CM22 type circuit breaker to be operatively coupled to a MG 8 or 9 type circuit breaker tank is provided. The operating handle assembly includes a tank assembly, which is coupled to the MG 8 or 9 type circuit breaker tank, and a circuit breaker, which is coupled to the CM22 type circuit breaker.

16 Claims, 7 Drawing Sheets

NETWORK PROTECTOR RETROFIT HANDLE ASSEMBLY

BACKGROUND OF THE INVENTION

1. Field of the Invention

The present invention relates to network protectors and, more specifically, to a retrofit handle assembly structured to allow one type of network protector circuit breaker to be used in a tank structured for a different type of network protector circuit breaker.

2. Background Information

Secondary power distribution networks consist of interlaced grids which are supplied by two or more sources of power so that the loss of a single source of power will not result in an interruption of service. Such secondary power distribution networks provide the highest level of reliability possible with conventional power distribution and are normally used to supply high-density load areas such as a section of a city, a large building, or an industrial site. Between a power source and the network is a transformer and a network protector. The network protector consists of a circuit breaker and a control relay. The circuit breaker includes at least one set of main contacts that move between an open position and a closed position. When the main contacts are closed, electricity may flow through the network protector. The control relay senses the transformer and network voltages and line currents then executes algorithms to initiate a tripping or closing action. Trip determination is based on detecting an overcurrent condition or reverse power flow, that is, power flow from the network to the energy source. Network protectors are often found in dust-proof and/or moisture-proof housings, or vaults, which are disposed in subterranean passageways in large metropolitan areas. More specifically, an enclosure, or "tank," is disposed with the vault and the network protector is disposed within the tank.

The network protector circuit breaker includes a number of other components such as, but not limited to, a bus assembly, an operating mechanism structured to move the contacts between the open position and the closed position, and a frame assembly. Typically, a close device may be either a non-stored energy device, wherein a motor or other device closes the contacts, or a stored energy device, wherein springs, which are compressed by a motor or by a crank, are used to close the main contacts. The frame assembly supports the circuit breaker and is structured to engage the tank. In a "roll-out" configuration, the tank includes a set of rails that may be extended from the tank and the frame assembly includes rollers which are disposed upon the rails. In this configuration, the circuit breaker may easily be moved into, and out of, the tank.

The tank includes a number of components that are coupled to the network protector components, or, that extend between the network protector and other elements of the power distribution network. For example, the tank includes a bus assembly having a line assembly and a load assembly. The tank bus assembly is structured to be coupled to the circuit breaker bus assembly so that electricity may flow through the network protector. The tank may also include an external operating handle. The operating handle is coupled to the circuit breaker operating mechanism shaft and is structured to actuate the operating mechanism. Generally, the operating handle may be moved to an "open" position wherein the circuit breaker operating shaft is rotated so that the contacts separate. During normal operation of the circuit breaker, the operating handle is set in an "automatic" position wherein the contacts are closed, but may be opened by the circuit breaker trip device or by an operator moving the handle to the open position. After the contacts have been opened, the operating handle may be moved to a "close" position wherein the contacts are moved in to the closed position and, typically, the trip device is reset. After the contacts have been closed, the operating handle is, typically, returned to the automatic position. Each of these components, as well as others, are structured to operate/engage a specific type of circuit breaker.

That is, the tank is structured to have a specific type of circuit breaker with components in a specific configuration disposed therein. Each type of circuit breaker, while generally performing the same function, includes various different components. For example, a CM22 type circuit breaker tank includes an operating handle that is structured to engage a CM22 type circuit breaker. Conversely, an MG 8 or 9 type circuit breaker tank includes an operating handle that is structured to engage a MG 8 or 9 type circuit breaker. Generally, a certain type of circuit breaker is not structured to be placed into a different type of circuit breaker tank. This is a disadvantage as older circuit breakers, such as the MG 8 or 9 type circuit breaker needs to be replaced and customers, typically, desire to have a newer type of circuit breaker, such as the CM22 type circuit breaker, installed.

While some changes, such as changes to the circuit breaker frame assembly, are relatively easy to accomplish, other changes require a retrofit device or assembly so that the tank for one type of circuit breaker may interface with the components of another type of circuit breaker. More specifically, there is a need for a retrofit operating handle assembly structured to allow a CM22 type circuit breaker to be operatively coupled to a MG 8 or 9 type circuit breaker tank.

SUMMARY OF THE INVENTION

This need, and others, is met by the present invention which provides a retrofit operating handle assembly structured to allow a CM22 type circuit breaker to be operatively coupled to a MG 8 or 9 type circuit breaker tank. The operating handle assembly includes a tank assembly, which is coupled to the MG 8 or 9 type circuit breaker tank, and a circuit breaker assembly, which is coupled to the CM22 type circuit breaker. The circuit breaker assembly consists, primarily, of a "torpedo" which is an elongated member having tapered ends which is fixed to the operating mechanism shaft. The tank assembly includes a torpedo bracket, a floating bracket, a linkage and an external handle. The torpedo bracket is structured to engage the torpedo when the circuit breaker is disposed within the tank. The torpedo bracket is rotatably coupled to the linkage and the floating bracket. The external handle is also coupled to the linkage. The floating bracket is coupled to the linkage and loosely coupled to the tank, and thus "floats," i.e. the bracket may be moved slightly. In this configuration, the mechanism self-centers over the operating mechanism shaft when the external handle is actuated.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, a "CM22 type circuit breaker" means a circuit breaker with Model Nos. CM22 and/or CM-22 manufactured by Eaton Corporation located at Eaton Center, 1111 Superior Avenue, Cleveland, Ohio 44114.

As used herein, a "MG 8 or 9 type circuit breaker" means a circuit breaker with Model Nos. MG8, MG-8, MG9, and/or MG-9 manufactured by Eaton Corporation located at Eaton Center, 1111 Superior Avenue, Cleveland, Ohio 44114 and formerly manufactured by Westinghouse Electric Corporation, Pittsburgh, Pa. 15219.

As used herein, a "pivot coupling" is a coupling between two or more members that allows the members to pivot relative to each other. A pivot coupling may be, but is not limited to, an opening on each member and a separate rod, wherein the rod extends through the openings.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two elements are so coupled to move as one.

As used herein, "floatingly coupled" means that two or more elements are coupled together in a manner that allows for limited motion therebetween.

As is known in the art, circuit breakers may have one or more pairs of separable contacts each being a different phase or "pole." Typically, each pair of separable contacts has an associated line conductor and load conductor which is not in electrical communication with the line/load conductor associated with a different pair of separable contacts. Similarly, the circuit breaker bus assembly and tank bus assembly each have a line bus and a load bus associated with each pair of separable contacts. As discussed below, in the preferred embodiment the circuit breaker has three pairs of separable contacts. Thus, as shown in the figures, the circuit breaker bus assembly has three-line buses and three load buses; however, it is understood that this invention applies to circuit breakers having more, or less, than three pairs of separable contacts and that the description and depiction of three pairs of separable contacts is exemplary only.

Figure 1:
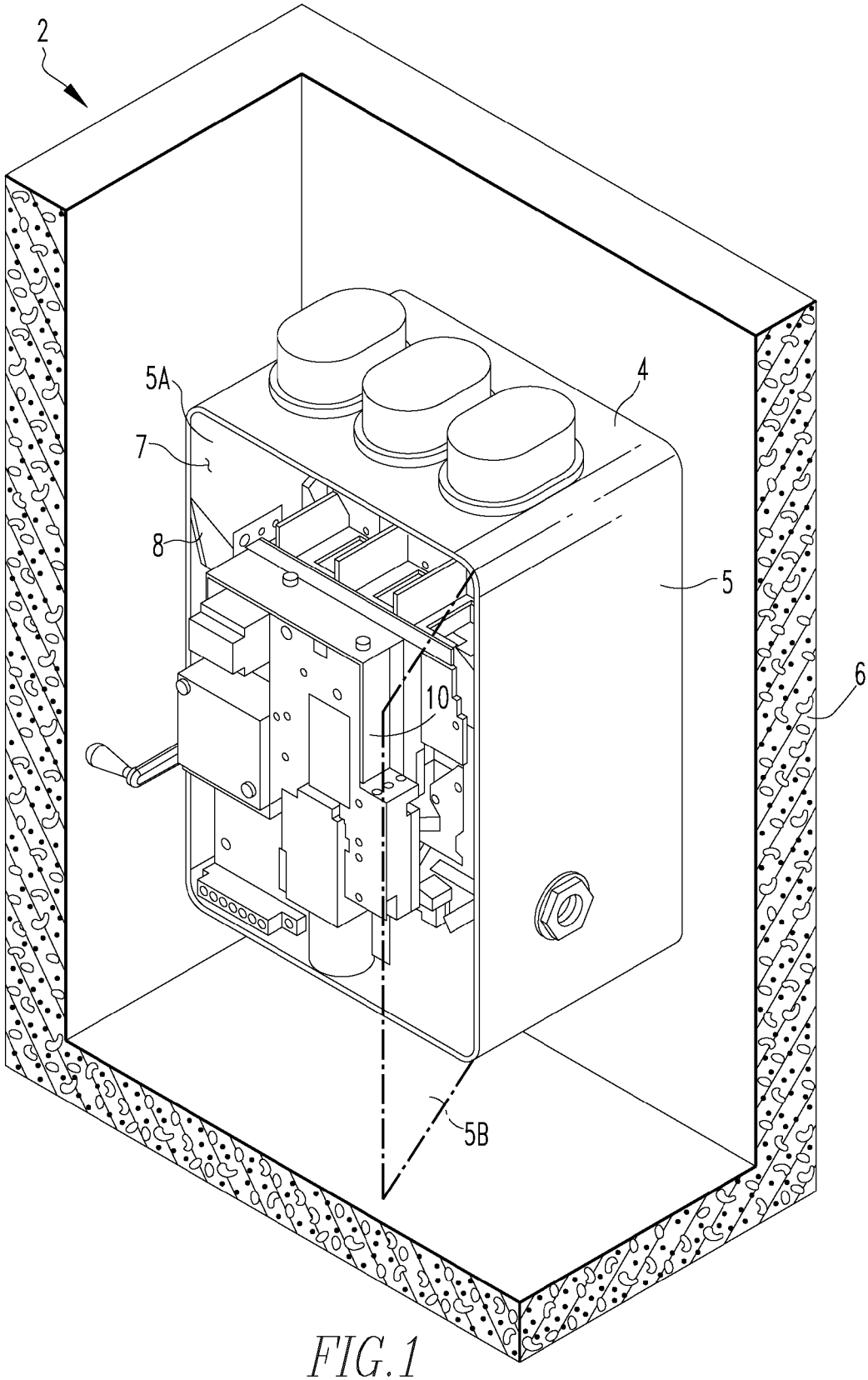
FIG. 1 is an isometric view of a network protector enclosure.
Figure 2:
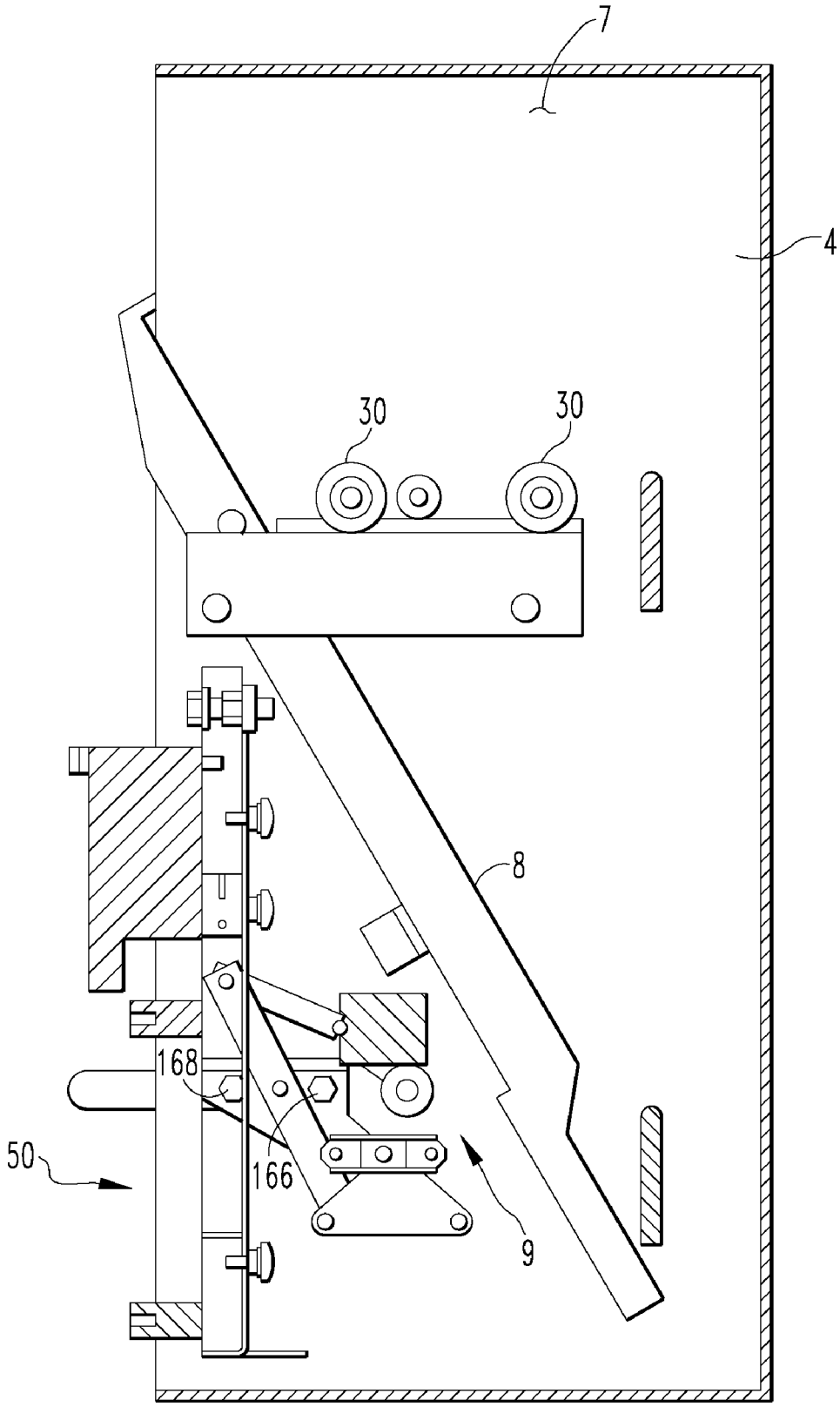
FIG. 2 is a side view of the interior wall of a tank.

As shown schematically in FIG. 1, a network protector enclosure 2 includes a tank 4 and may include a vault 6. The tank 4 includes a plurality of generally planar sidewalls 5 configured to define an enclosed space 7. It is understood that the tank 4 is constructed to accommodate and engage a MG 8 or 9 type circuit breaker and would typically include an external handle assembly structured to engage the operating mechanism shaft of the MG 8 or 9 type circuit breaker. The original external handle assembly has, however, been removed and replaced by the retrofit external handle assembly 50 as shown and described below. The sidewall 5 having the retrofit external handle assembly 50, as shown on the left sidewall 5A includes an opening therethrough 9. The tank 4 also includes a removable sidewall 5B, or door. As shown in FIG. 2, the tank 4 also includes a pair of elongated, extendable rails 8 structured to support a circuit breaker 10 as described below. The extendable rails 8 are structured to move between a withdrawn position, wherein the extendable rails 8 are disposed within the enclosed space 7, and an extended position, wherein the extendable rails 8 extend generally horizontally and extend from within the enclosed space 7 to a location outside the tank 4. The tank 4 also includes a bus assembly (not shown) that has bus members in electrical communication with either the power source or the load.

Figure 3:
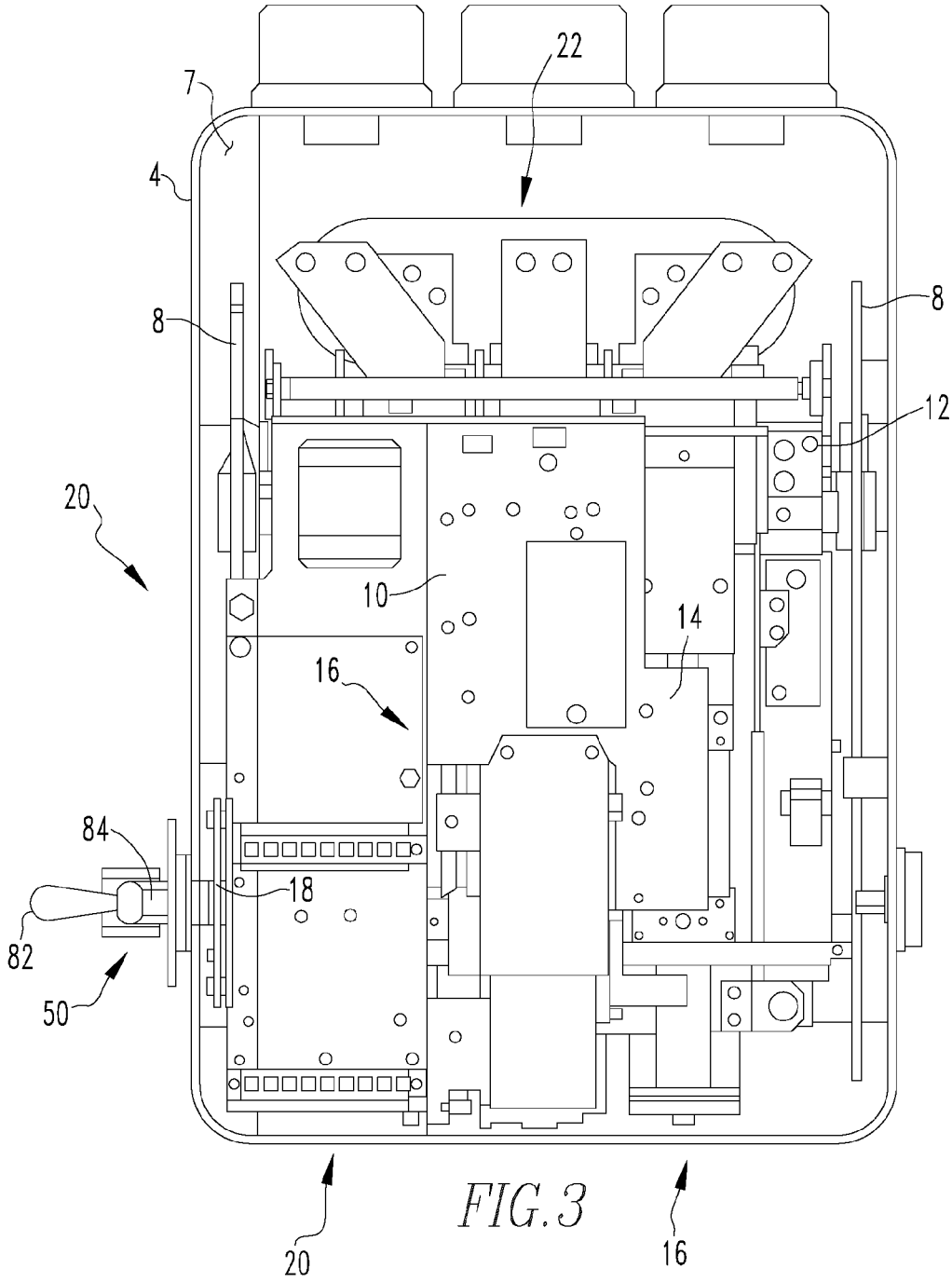
FIG. 3 is a front view of a circuit breaker in a tank.
Figure 4:
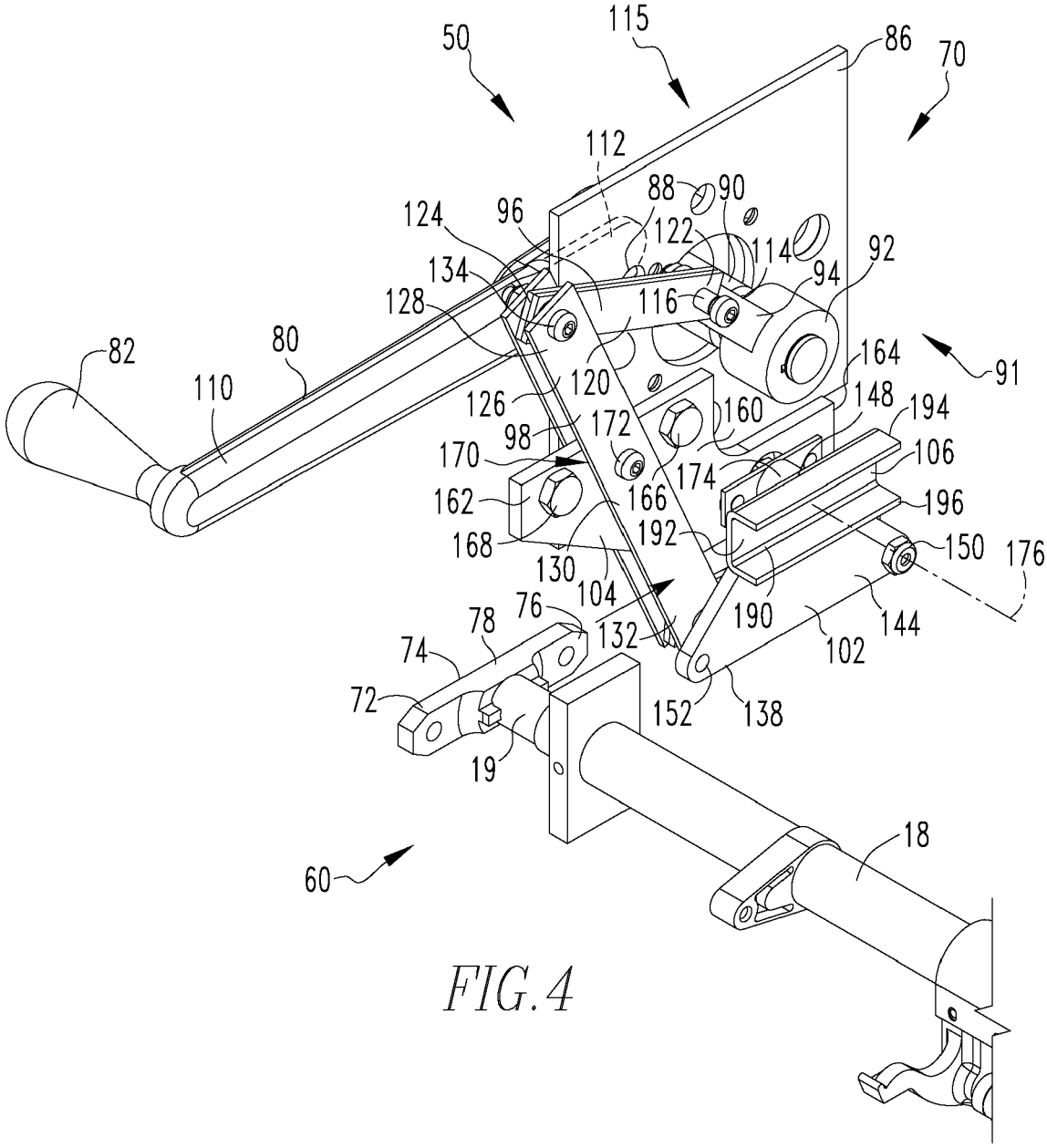
FIG. 4 is a detailed isometric view of the retrofit external handle assembly with the circuit breaker out of the tank and the retrofit external handle assembly in the open position.
Figure 5:
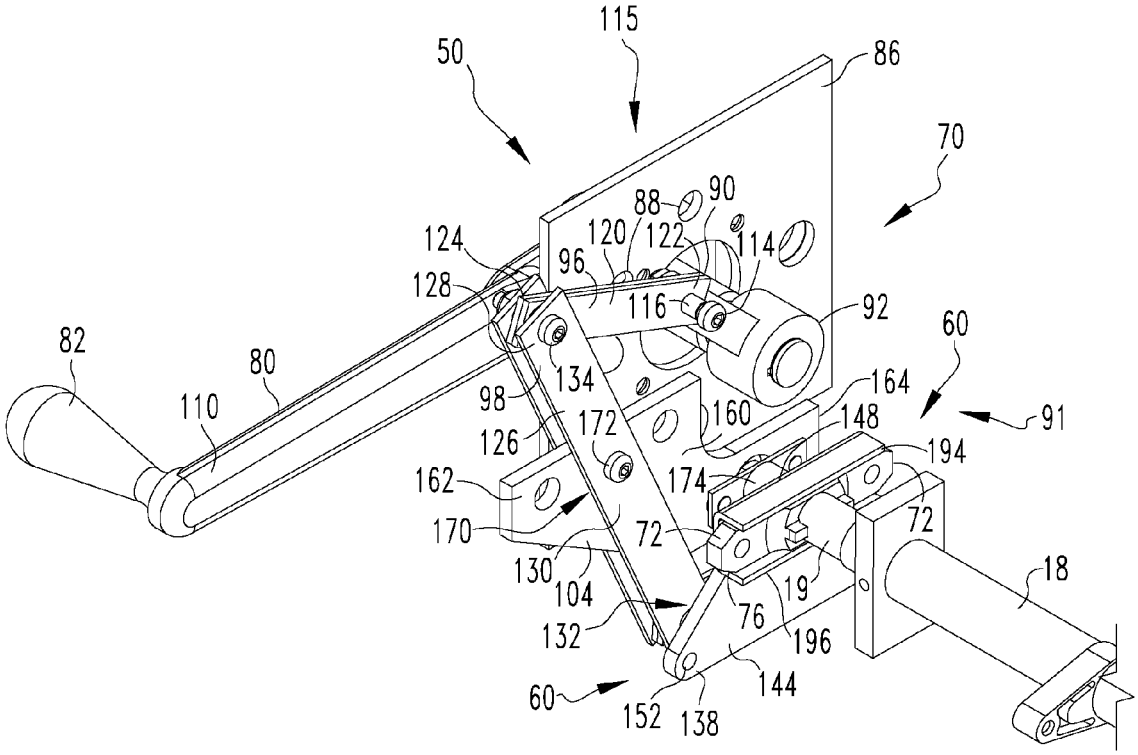
FIG. 5 is a detailed isometric view of the retrofit external handle assembly with the circuit breaker in the tank and the retrofit external handle assembly in the open position.
Figure 6:
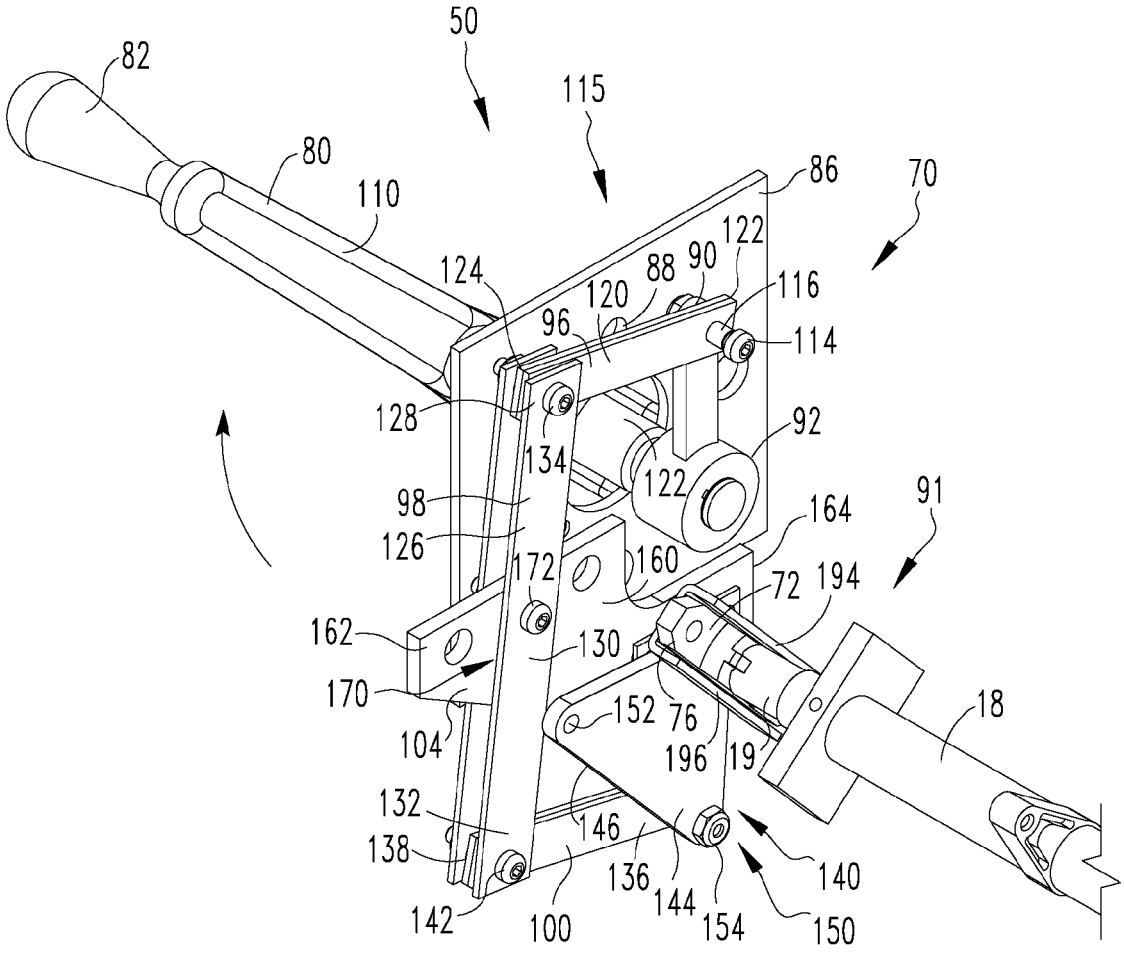
FIG. 6 is a detailed isometric view of the retrofit external handle assembly with the circuit breaker in the tank and the retrofit external handle assembly in the automatic position.
Figure 7:
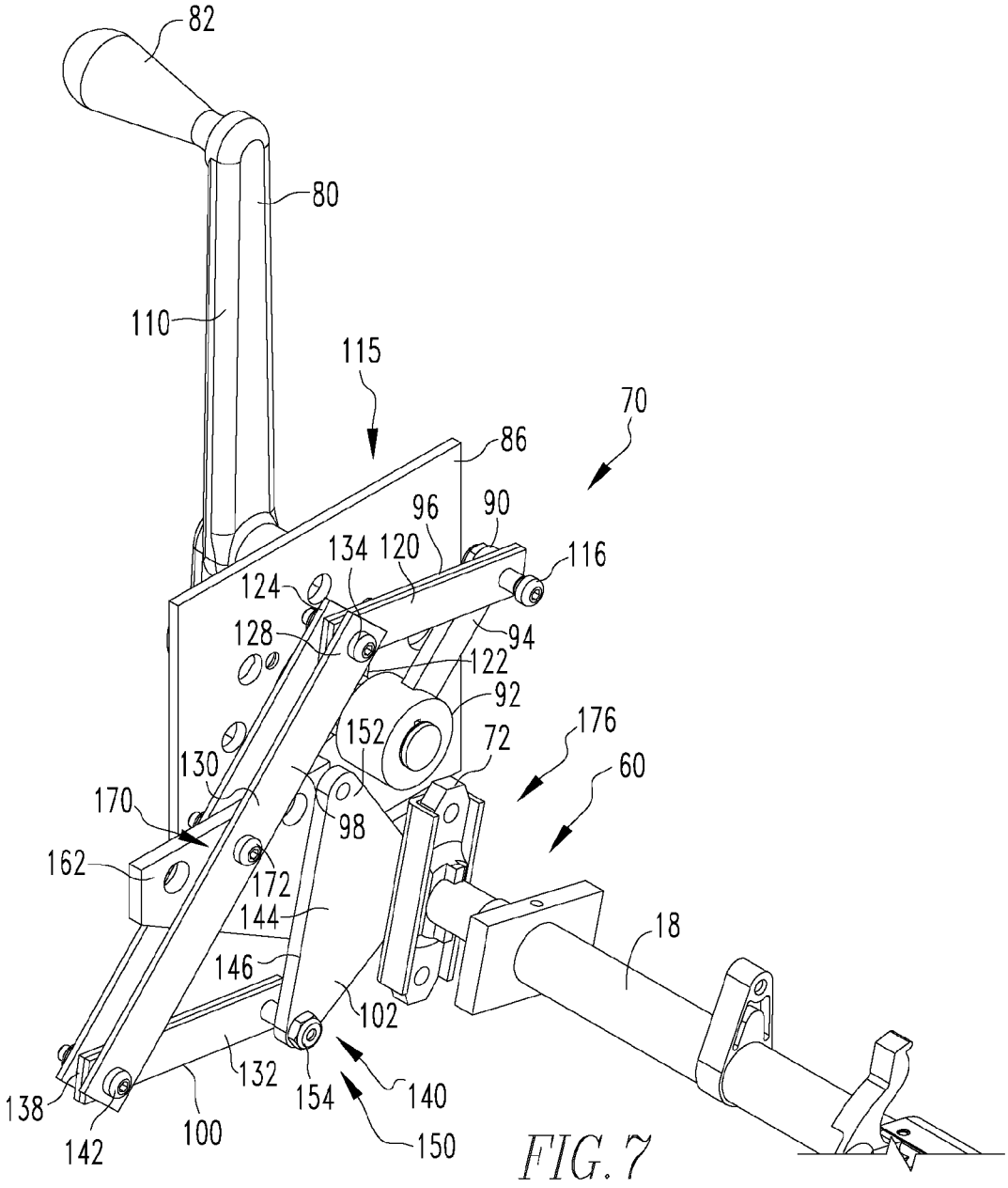
FIG. 7 is a detailed isometric view of the retrofit external handle assembly with the circuit breaker in the tank and the retrofit external handle assembly in the close position.

As shown in FIG. 3, the CM22 type circuit breaker 10 includes a frame assembly 12, a housing 14, an operating mechanism 16 having an operating mechanism shaft 18, a trip device 20, and a circuit breaker bus assembly 22. As is known in the art, within the housing 14 are three pairs of separable contacts (not shown). Each pair of contacts is in electrical communication with the circuit breaker bus assembly 22. The trip device 20 is structured to separate each pair of the contacts upon the occurrence of a trip condition. The operating mechanism 16 is structured to manually separate each pair of the contacts and to close the contacts following an automatic or manual trip. That is, the separable contacts are structured to move between a closed position, wherein the contacts are in electrical communication, and an open position, wherein the contacts are not in electrical communication.

Rotation of the operating mechanism shaft 18 causes the separable contacts to move between the open and closed positions. Further, as is known in the art, rotation of the operating mechanism shaft 18 may also be used to reset the trip device 20 as the separable contacts are moved into the closed position. Thus, the operating mechanism 16 and the operating mechanism shaft 18 may be moved through three positions; an "open" position wherein the separable contacts are moved into an open position, an "automatic" position, wherein the trip device 20 is set and ready to trip and the separable contacts are closed, and a "close" position wherein the separable contacts are closed. During normal operation, that is, when current is flowing through the circuit breaker 10, the operating mechanism 16 and the operating mechanism shaft 18 are in the automatic position. The operating mechanism 16 and the operating mechanism shaft 18 may be moved into the open position manually by using the retrofit external handle assembly 50, discussed below. Alternately, following actuation of the trip device 20, the contacts separate and the operating mechanism 16 and the operating mechanism shaft 18 are automatically moved into the open position. Once the contacts are open, the contacts may be closed, and the trip device 20 reset, by moving the operating mechanism 16 and the operating mechanism shaft 18 into the closed position. The operating mechanism shaft 18 has a distal, exposed end 19 which, as shown, extends to the left of the frame assembly 12 and adjacent to the tank left sidewall 5A.

The circuit breaker frame assembly 12 includes a plurality of wheels 30, preferably two pairs, structured to movably engage the tank extendable rails 8. That is, by rolling over the tank extendable rails 8, the circuit breaker 10 may be moved between an installed position, wherein the circuit breaker 10 is within the tank 4 and the circuit breaker bus assembly 22 engages, and is in electrical communication with, the tank bus assembly, and a withdrawn position, wherein the circuit breaker 10 is outside of the tank 4 and the circuit breaker bus assembly 22 has been disengaged from the tank bus assembly. The operating mechanism shaft 18 is structured to engage/ disengage the retrofit external handle assembly 50 as the circuit breaker 10 is moved into/out of the tank 4.

As shown in FIGS. 4-7, the retrofit external handle assembly 50 includes two components, a circuit breaker assembly 60 and a tank assembly 70. The handle assembly circuit breaker assembly 60 consists, primarily, of a torpedo 72 that is fixed to the operating mechanism shaft exposed end 19. The torpedo 72 is an elongated, generally flat body 74 having a width and tapered first end 76 and a medial portion 78. The torpedo 72 may be fixed to the operating mechanism shaft exposed end 19 by any conventional device or means. The operating mechanism shaft exposed end 19 is coupled to the torpedo medial portion 78. The torpedo 72 is fixed to the operating mechanism shaft exposed end 19 so that when the operating mechanism shaft 18 is in the open position, the torpedo 72 extends generally horizontally. Further, when the operating mechanism shaft 18 is in the automatic position, the torpedo 72 extends generally 45 degrees relative to a horizontal axis. Finally, when the operating mechanism shaft 18 is in the close position, the torpedo 72 extends generally vertically.

The handle assembly tank assembly 70 includes an elongated handle member 80 having a perpendicular grip 82 and a positioning mechanism 84, a handle plate 86 having a plurality of position openings 88, a shaft 90, a plurality of links 91, a floating bracket 104, and a torpedo bracket 106. The plurality of links 91 preferably includes a hub 92 having a radial link 94, a first link 96, a second link 98, a third link 100, a fourth link 102, a floating bracket 104, and a torpedo bracket 106. The handle member 80 has a first end 110 and a second end 112. The grip 82 is disposed at the handle member first end 110. The handle member second end 112 is fixed to the shaft 90. The shaft 90 extends generally perpendicular to the handle member 80. The shaft 90 extends through the tank left sidewall opening 9. The hub 92 is fixed to the shaft 90 within the tank 4. The plurality of links 91, which are preferably the radial link 94, first link 96, second link 98, a third link 100 (FIG. 6) and a fourth link 102, are coupled together in series by a plurality of pivot couplings 115.

That is, the radial link 94 extends radially from the hub 92 and has a distal end 114. The first link 96 has an elongated body 120 having a first end 122 and a second end 124. The radial link distal end 114 and the first link first end 122 are coupled together by a first pivot coupling 116. The second link 98 has an elongated body 126 having a first end 128, a medial portion 130, and a second end 132. The first link second end 124 and the second link first end 128 are coupled together by a second pivot coupling 134. The third link 100 has a body 136 having a first end 138 and a second end 140. The second link second end 130 and the third link first end 138 are coupled together by a third pivot coupling 142. The fourth link 102 has a triangular body 144. The triangular shape of the body 144 allows the retrofit external handle assembly 50 to be installed on either the left side or right side of the housing 14. If the third link 100 is a triangular body 144, it includes a base edge 146 and an opposing vertex 148. Adjacent to the base edge 146 is a first corner 150 and a second corner 152. The third link second end 140 and the fourth link first corner 150 are coupled together by a fourth pivot coupling 154.

The floating bracket 104 has a generally flat body 160 having an upper portion 162 and a lower portion 164. The floating bracket upper portion 162 is laterally offset from the floating bracket lower portion 164. The floating bracket 104 is loosely attached, or floatingly coupled, to the tank left sidewall 5A. That is, the tank left sidewall 5A has two inwardly extending pins 166, 168 to which the floating bracket 104 is loosely coupled. In this configuration, the floating bracket 104 is maintained, generally, in one orientation, but allowed to move slightly vertically. The floating bracket upper portion 162 has a second link opening 170 therethrough. The second link medial portion 130 and the floating bracket upper portion 162 are coupled together by a fifth pivot coupling 172. The floating bracket lower portion 164 and the fourth link vertex 148 are coupled together by a sixth pivot coupling 174. It is noted that, because the floating bracket 104 is generally stationary, except for the slight vertical movement allowed, the sixth pivot coupling 174 is also generally stationary with regard to horizontal movement. The sixth pivot coupling 174 has an axis of rotation 176 that extends generally perpendicular to the tank left sidewall 5A. The sixth pivot coupling axis of rotation 176 is generally aligned with the axis of the operating mechanism shaft 18. As noted above, the plurality of links 91, preferably includes each of the links identified above which are coupled together in series by a plurality of pivot couplings 115. However, if a fewer number of links are used, at least one link, as shown in the fourth link 102, must have the torpedo bracket 106 fixed thereto, as described below.

The torpedo bracket 106 has an elongated body 190 having a base plate 192 and a side plate 194, 196 disposed at each longitudinal edge. That is, the torpedo bracket body 190 has a generally U-shaped cross-section. The torpedo bracket base plate 192 has a width that is substantially similar to, or slightly larger than, the torpedo 72. In this configuration, the torpedo 72 is structured to be snugly, but removably, disposed within the torpedo bracket 106. That is, the torpedo 72 is structured to have a minimal amount of play when disposed within the torpedo bracket 106. The torpedo bracket 106 is fixed to the fourth link vertex 148. That is, unlike the various pivot couplings disclosed above, the torpedo bracket 106 is structured to rotate with the fourth link body 144.

In this configuration, tank assembly handle member 80 is disposed outside of the tank 4 and is operatively coupled to the torpedo bracket 106 so that rotation of the tank assembly handle member 80 causes the torpedo bracket 106 to rotate. Preferably, the handle assembly tank assembly 70 is structured to rotate the torpedo bracket 106 in a motion corresponding to the motion of the handle member 80. Accordingly, it is preferred that the handle member 80 be coupled to the shaft 90 in an orientation corresponding to the orientation of the torpedo bracket 106. Thus, for example, when the handle member 80 extends generally horizontally, the longitudinal axis of the torpedo bracket 106 extends generally horizontally. That is, as the handle member 80 and the torpedo bracket 106 move between the different positions, the orientation of the handle member 80 corresponds to the orientation of the torpedo bracket 106.

The handle assembly tank assembly 70 is structured to move between a first position, a second position and a third position. In the first position, the handle member 80 extends generally horizontally and the longitudinal axis of the torpedo bracket 106 extends generally horizontally. In the second position, the handle member 80 extends generally 45 degrees relative to a horizontal axis and the longitudinal axis of the torpedo bracket 106 extends generally 45 degrees relative to a horizontal axis. In the third position, the handle member 80 extends generally vertically and the longitudinal axis of the torpedo bracket 106 extends generally vertically.

Thus, in this configuration, the circuit breaker 10 may be moved in and out of the tank 4 when the handle assembly tank assembly 70 is in the first position and the circuit breaker 10 may not be moved in and out of the tank 4 when the handle assembly tank assembly 70 is in either the second or third positions. That is, when installing a circuit breaker 10, the operating mechanism 16 and the operating mechanism shaft 18 are in the open position. Thus, the torpedo 72 extends generally horizontally. To install the circuit breaker 10 within the tank 4, the torpedo 72 must engage the handle assembly tank assembly 70. Thus, the handle assembly tank assembly 70 is placed in the first position so that the handle member 80 extends generally horizontally and the longitudinal axis of the torpedo bracket 106 extends generally horizontally. The circuit breaker 10 is moved generally horizontally over the tank extendable rails 8 into the tank 4. When the torpedo 72, and more specifically the torpedo tapered first end 76, engages the torpedo bracket 106, the torpedo bracket 106, and the entire handle assembly tank assembly 70, will shift vertically to automatically align with the operating mechanism shaft 18. That is, because the handle assembly tank assembly 70 is coupled to the tank 4 by the floating bracket 104, the play within the floating bracket 104 coupling to the tank left sidewall 5A allows the handle assembly tank assembly 70 to shift vertically. As the circuit breaker 10 continues to move into the tank 4, the torpedo 72 is moved fully into the torpedo bracket 106. That is, the torpedo body 74 is disposed within the U-shaped torpedo bracket body 190. When the circuit breaker 10 is fully installed within the tank 4, the sixth pivot coupling axis of rotation 176 is generally aligned with the axis of the operating mechanism shaft 18.

Once the circuit breaker 10 is fully installed within the tank 4 and the sidewall 5B closed, a user may rotate the handle assembly tank assembly 70 to the third position. That is, the handle member 80 may be moved to a generally vertical position which, in turn, causes the torpedo bracket 106 to rotate into a generally vertical position. Because the torpedo 72 is trapped in the torpedo bracket 106, both the torpedo 72 and the operating mechanism shaft 18 to which the torpedo 72 is fixed will also rotate. As the operating mechanism shaft 18 rotates, the operating mechanism 16 is moved into the close position and the contacts are closed. The handle member 80 may then be moved into the second position, wherein the handle member 80 extends generally 45 degrees relative to a horizontal axis and the longitudinal axis of the torpedo bracket 106 extends generally 45 degrees relative to a horizontal axis. Again, both the torpedo 72 and the operating mechanism shaft 18 to which the torpedo 72 is fixed will also rotate into the automatic position corresponding to the 45 degree angle of the torpedo bracket 106. It is further noted that in this position, the circuit breaker 10 may not be moved out of the tank 4 as circuit breaker 10 travels generally horizontally and the torpedo 72 is trapped in the torpedo bracket 106 at a 45 degree angle. That is, the circuit breaker 10 may only be moved out of the tank 4 when the longitudinal axis of the torpedo 72 and the longitudinal axis of the torpedo bracket 106 extend generally parallel to the longitudinal axis of the extendable rails 8. Thus, when the torpedo 72 and the torpedo bracket 106 are oriented in a direction other than generally parallel to the extendable rails 8, that is, when the operating mechanism 16 and the operating mechanism shaft 18 are in the automatic or close positions, the circuit breaker 10 may not be moved out of the tank 4.

To remove the circuit breaker 10 from the tank 4, a user must move the handle member 80 into the first position wherein the handle member 80 extends generally horizontally and the longitudinal axis of the torpedo bracket 106 extends generally horizontally. As before, as the torpedo bracket 106 is moved into a generally horizontal orientation, the torpedo 72 and the operating mechanism shaft 18 to which the torpedo 72 is fixed will also move into a generally horizontal orientation, which, as noted above, is the open position for the operating mechanism 16 and the contacts are moved into the open position. Once the torpedo 72 and the torpedo bracket 106 are in the horizontal position, the torpedo 72 may slide out of the torpedo bracket 106 as the circuit breaker 10 is moved horizontally on the tank extendable rails 8. Thus, the circuit breaker 10 may only be removed from the tank 4 when the operating mechanism 16, and therefore the contacts, are in the open position. Alternately, the handle member 80 may be moved into the first position following an over-current event. That is, following an over-current event, the trip device 20 will be actuated and the operating mechanism 16 separates the contacts. As the operating mechanism 16 separates the contacts, the operating mechanism shaft 18 is rotated into the open position. As the operating mechanism shaft 18 rotates, the handle member 80 is moved into the first position.

The handle assembly tank assembly 70 may further include a positioning mechanism 84 structured to maintain the handle member 80 in one position. The positioning mechanism 84 includes a biased detent, or similar element, (not shown) structured to engage one of the position openings 88 on the handle plate 86 when the handle member 80 is in one of the three defined positions.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A retrofit handle assembly for a network protector enclosure, said enclosure having at least a tank with a plurality of generally planar sidewalls defining an enclosed space, at least one said sidewall having an opening therethrough and another sidewall being removable thereby providing access to said enclosed space, said tank further having a pair of elongated extendable rails structured to support a circuit breaker, said circuit breaker having a frame assembly, a housing, an operating mechanism, and a trip device, said operating mechanism having a shaft with an exposed end, said circuit breaker being movably disposed on said rails and being movable between an installed position, wherein said circuit breaker is within said tank, and a withdrawn position, wherein said circuit breaker is substantially outside said tank, and wherein, when said circuit breaker is in said installed position, said operating mechanism shaft exposed end is disposed adjacent to said sidewall opening; said retrofit handle assembly comprising:

a circuit breaker assembly having an elongated torpedo fixed to said operating shaft exposed end, wherein rotation of said torpedo causes said operating mechanism to be actuated;

a tank assembly having an external handle member and a torpedo bracket;

said handle member being disposed outside of said tank and being operatively coupled to said torpedo bracket wherein rotation of said handle member causes said torpedo bracket to rotate;

said torpedo bracket sized to snugly, but removably, engage said torpedo;

said torpedo structured to be engaged by said torpedo bracket when said circuit breaker is in said installed position; and wherein said circuit breaker operating mechanism may be actuated by said handle member.

2. The retrofit handle assembly of claim 1 wherein said circuit breaker operating mechanism and said operating mechanism shaft move between three positions namely, an open position, an automatic position and a close position, said extendable rails move between a withdrawn position and an extended position, said circuit breaker may only travel over said rails when said rails are in the extended position, and wherein:

said torpedo has and elongated body;

said torpedo rotates with said operating mechanism shaft;

said torpedo bracket has and elongated body;

said torpedo being structured to slide longitudinally into said torpedo bracket;

wherein said handle member and said torpedo bracket are structured to move between an open position, an automatic position, and a close position corresponding to the open position, automatic position and close position of said operating mechanism and said operating mechanism shaft;

wherein the longitudinal axis of said torpedo and the longitudinal axis of said torpedo bracket extend generally parallel to the longitudinal axis of said extendable rails when said operating mechanism shaft is in said open position; and whereby said circuit breaker may be moved over said rails so as to slide said torpedo out of said torpedo bracket when said operating mechanism is in said open position.

3. The retrofit handle assembly of claim 2 wherein:

when said operating mechanism and said operating mechanism shaft are in the automatic position, the longitudinal axis of said torpedo and the longitudinal axis of said torpedo bracket do not extend generally parallel to the longitudinal axis of said extendable rails;

when said operating mechanism and said operating mechanism shaft are in the close position, the longitudinal axis of said torpedo and the longitudinal axis of said torpedo bracket do not extend generally parallel to the longitudinal axis of said extendable rails;

whereby said circuit breaker may not be moved over said rails so as to slide said torpedo out of said torpedo bracket when said operating mechanism is in said automatic position; and whereby said circuit breaker may not be moved over said rails so as to slide said torpedo out of said torpedo bracket when said operating mechanism is in said close position.

4. The retrofit handle assembly of claim 2 wherein said extendable rails extend generally horizontally in the extended position and wherein: and the longitudinal axis of said torpedo and the longitudinal axis of said torpedo bracket extend generally horizontally when said operating mechanism shaft is in said open position.

5. The retrofit handle assembly of claim 2 wherein said handle member moves in a motion corresponding to the motion of said torpedo bracket so that the orientation of said handle member corresponds to the orientation of said torpedo bracket.

6. The retrofit handle assembly of claim 5 wherein:

said torpedo body has tapered ends; and said torpedo bracket has a generally U-shaped cross-section having a base plate and two side plates, one side plate disposed at each longitudinal edge;

said torpedo bracket base plate having a width that is substantially similar to the width of said torpedo; and wherein said torpedo may slide longitudinally between said torpedo bracket side plates and be snugly trapped in said torpedo bracket.

7. The retrofit handle assembly of claim 2 wherein:

said tank assembly further includes a floating bracket floatingly coupled to said sidewall having said opening;

said torpedo bracket being pivotally coupled to said floating bracket; and wherein said torpedo bracket is structured to automatically align with said torpedo as said circuit breaker moves into said tank.

8. The retrofit handle assembly of claim 7 wherein:

said tank assembly further includes a shaft and a plurality of links;

said shaft extending through said opening in said tank sidewall;

said handle member coupled to the external end of said shaft;

said plurality of links coupled to the internal end of said shaft;

said plurality of links being coupled together in series by a plurality of pivot couplings; and said torpedo bracket being fixed to said at least one link that is pivotally coupled to said floating bracket.

9. The retrofit handle assembly of claim 8 wherein:

said plurality of links including a hub having a radial link, a first link, a second link, a third link, and a fourth link;

said second link and said fourth link each being pivotally coupled to said floating bracket; and said torpedo bracket being fixed to said fourth link.

10. The retrofit handle assembly of claim 9 wherein:

said radial link has a distal end;

said first link has an elongated body having a first end and a second end; said radial link distal end and said first link first end coupled together by a first pivot coupling;

said second link has an elongated body having a first end, a medial portion, and a second end;

said first link second end and said second link first end coupled together by a second pivot coupling;

said third link has an elongated body having a first end and a second end;

said second link second end and said third link first end coupled together by a third pivot coupling;

said fourth link has a triangular body having a base edge and an opposing vertex, said base edge having a first corner and a second corner;

said third link second end and said fourth link first corner coupled together by a fourth pivot coupling;

said torpedo bracket being fixed to said fourth link at said vertex; and said fourth link vertex is coupled to said floating bracket by a sixth pivot coupling.

11. The retrofit handle assembly of claim 10 wherein:

said floating bracket has a generally flat body having an upper portion and a lower portion, said floating bracket upper portion being laterally offset from the floating bracket lower portion; and said second link medial portion and said floating bracket upper portion being pivotally coupled together by a fifth pivot coupling.

12. The retrofit handle assembly of claim 8 wherein:

when said operating mechanism and said operating mechanism shaft are in the automatic position, the longitudinal axis of said torpedo and the longitudinal axis of said torpedo bracket do not extend generally parallel to the longitudinal axis of said extendable rails;

when said operating mechanism and said operating mechanism shaft are in the close position, the longitudinal axis of said torpedo and the longitudinal axis of said torpedo bracket do not extend generally parallel to the longitudinal axis of said extendable rails;

whereby said circuit breaker may not be moved over said rails so as to slide said torpedo out of said torpedo bracket when said operating mechanism is in said automatic position; and whereby said circuit breaker may not be moved over said rails so as to slide said torpedo out of said torpedo bracket when said operating mechanism is in said close position.

13. The retrofit handle assembly of claim 12 wherein said extendable rails extend generally horizontally in the extended position and wherein:

the longitudinal axis of said torpedo and the longitudinal axis of said torpedo bracket extend generally horizontally when said operating mechanism shaft is in said open position.

14. The retrofit handle assembly of claim 13 wherein said handle member moves in a motion corresponding to the motion of said torpedo bracket so that the orientation of said handle member corresponds to the orientation of said torpedo bracket.

15. The retrofit handle assembly of claim 14 wherein:

said torpedo body has tapered ends; and said torpedo bracket has a generally U-shaped cross-section having a base plate and two side plates, one side plate disposed at each longitudinal edge;

said torpedo bracket base plate having a width that is substantially similar to the width of said torpedo; and wherein said torpedo may slide longitudinally between said torpedo bracket side plates and be snugly trapped in said torpedo bracket.

16. The retrofit handle assembly of claim 14 wherein:

said tank assembly includes a handle plate having a plurality of position openings and a positioning mechanism;

said handle plate being disposed outside the tank adjacent to said handle member;

said positioning mechanism disposed on said handle member;

said positioning mechanism structured to engage a single handle plate position opening when said handle is in one of said open, automatic, or closed positions.

* * * * *